United States Patent [19]

Miller et al.

[11] 4,185,916

[45] Jan. 29, 1980

[54] COMPOSITE DEVELOPER PARTICLES AND APPARATUS FOR USING SAME

[75] Inventors: Roger L. Miller, Penfield; Lloyd F. Bean, Rochester, both of N.Y.

[73] Assignee: Xerox Corporation, Stamford, Conn.

[21] Appl. No.: 785,798

[22] Filed: Apr. 8, 1977

[51] Int. Cl.[2] ..... G03G 15/08; G03G 15/09

[52] U.S. Cl. ..... 355/3 DD; 118/653; 118/658; 118/657; 430/111; 430/136

[58] Field of Search ..... 252/62.1 P; 96/15 D; 427/18; 355/3 DD; 118/657, 656, 653, 658

[56] References Cited

U.S. PATENT DOCUMENTS

| | | | |
|---|---|---|---|
| 2,846,333 | 8/1958 | Wilson | 427/18 |
| 3,152,924 | 10/1964 | Wanielista et al. | 427/18 |
| 3,639,245 | 2/1972 | Nelson | 252/62.1 |
| 3,645,770 | 2/1972 | Flint | 96/15 D |
| 3,909,258 | 9/1975 | Kotz | 427/18 |
| 4,003,334 | 1/1977 | Samuels | 427/18 |
| 4,014,291 | 3/1977 | Davis | 427/18 |

*Primary Examiner*—Roland E. Martin, Jr.
*Attorney, Agent, or Firm*—J. J. Ralabate; C. A. Green; H. Fleischer

[57] ABSTRACT

A composite particle comprising a conductive portion and an insulating portion. The insulating portion is integral and contiguous with the conductive portion.

20 Claims, 6 Drawing Figures

COMPOSITE DEVELOPER PARTICLES AND APPARATUS FOR USING SAME

The foregoing abstract is not intended to define the invention disclosed in the invention, nor is it intended to be limiting as to the scope of the invention in any way.

BACKGROUND OF THE INVENTION

This invention relates generally to a reproducing machine, and more particularly concerns the developer material employed therein to render a latent image visible.

Though there are various types of reproducing machines, the most commonly available are electrostatographic printing machines. In an electrostatographic printing machine, a latent image is recorded on a surface and rendered visible with particles. These particles may be transferred to a sheet of support material, in image configuration, or remain on the recording surface. In either of the foregoing cases, the particles are permanently affixed to the sheet of support material or recording surface. Thus, a copy of an original document is formed.

Electrostatographic printing includes both electrophotographic and eletrographic printing. Electrophotographic printing employs a light image of the original document to dissipate a charged photoconductive surface. This results in a latent image of the original document being recorded on the photoconductive surface. The latent image is subsequently developed with particles. Electrographic printing does not employ a photoconductive member or a light image to create a latent image of the original document. In general, both of the foregoing processes employ particles to develop the latent image. These particles are subsequently permanently affixed to the copy sheet by the application of heat and/or pressure thereto.

A typical developer material comprises a finely divided colored material called "toner" adhering triboelectrically to a slightly more coarsely divided material called a "carrier". This two-component developer material contacts the latent image. The toner particles are attracted from the carrier granules to the latent image rendering it visible. Generally, the carrier granules are made from a ferro-magnetic material while the toner particles are made from a thermoplastic material. Typically, the toner particles used in a two-component developer mixture of this type have resistivities ranging from about $10^{14}$ to about $10^{17}$ ohm-cm.

Various methods have been developed for applying the developer material to the latent image. For example, the developer material may be cascaded over the latent image and the toner particles attracted from the carrier granules thereto. Other apparatus employed to develop the latent image include the use of polar members or magnetic field producing devices forming brush-like tufts extending outwardly therefrom and contacting the photoconductve surface.

With the advent of single component developer materials, i.e. conductive particles, carrier granules are no longer required. U.S. Pat. No. 2,846,333 issued to Wilson in 1956 describes a typical single component developer material. In general, the charged particles employed as a single component developer material have low resistivities which ranges from about $10^4$ to about $10^9$ ohm-cm. These particles are developed on the latent image. However, when the particles are transferred to the copy sheet repulsion occurs. Transfer is optimized by employing particles having high resistivities. Contrawise, development is optimized by utilizing particles having low resistivity or good conductivity. Thus, the system is faced with two contradictory requirements, i.e. toner particles having low resistivity for optimum development and high resistivity for optimum transfer.

Hereinbefore, various types of developer materials have been developed. For example, U.S. Pat. No. 3,639,245 issued to Nelson in 1972 discloses particles having a highly resistive interior core and a highly conductive surface or shell. This patent also discloses particles made from a thermoplastic material having conductive particles embedded therein. U.S. Pat. No. 3,816,840 issued to Kotz in 1974 also describes particles having an insulating core with a conductive exterior surface. In both of the foregoing patents, the particles are described as being magnetic. U.S. Pat. No. 3,345,294 issued to Cooper in 1967 discloses particles made from a polyamide resin having magnetic particles dispersed there. An electrostatic ink powder made from thermoplastic resin having a coating of carbon adhering thereto is described in U.S. Pat. No. 3,196,032 issued to Seymour in 1965. Other patents describing a developer comprising particles dispersed in a liquid are U.S. Pat. Nos. 3,155,513; 3,241,998; 3,244,633; 3,406,062; and 3,438,904. U.S. Pat. Nos. 3,607,363 and 3,775,103 disclose photoconductive particles dispersed in a resin or mixed with a non-conductive powder. Metal carriers coated with an acrylic resin or a polymer are described in U.S. Pat. Nos. 3,900,414 and 3,939,086. Finally, U.S. Pat. No. 3,766,072 discloses a developer comprising insulating and conductive particles; and U.S. Pat. No. 3,901,695 describes a metal carrier blended with infrangible and frangible resins.

Accordingly, it is a primary object of the present invention to improve single component developer materials employed to render latent images visible.

SUMMARY OF THE INVENTION

Briefly stated, and in accordance with the present invention, there is provided a composite particle for developing a latent image.

Pursuant to the features of the invention, the composite particle includes a conductive portion and an insulating portion. The insulating portion is integral and contiguous with the conductive portion.

BRIEF DESCRIPTION OF THE DRAWINGS

Other objects and advantages of the present invention will become apparent upon a reading of the following detailed description and upon reference to the drawings, in which.

While the present invention will hereinafter be described in connection with preferred embodiments and methods of use therefor, it will be understood that it is not intended to limit the invention to these methods and embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
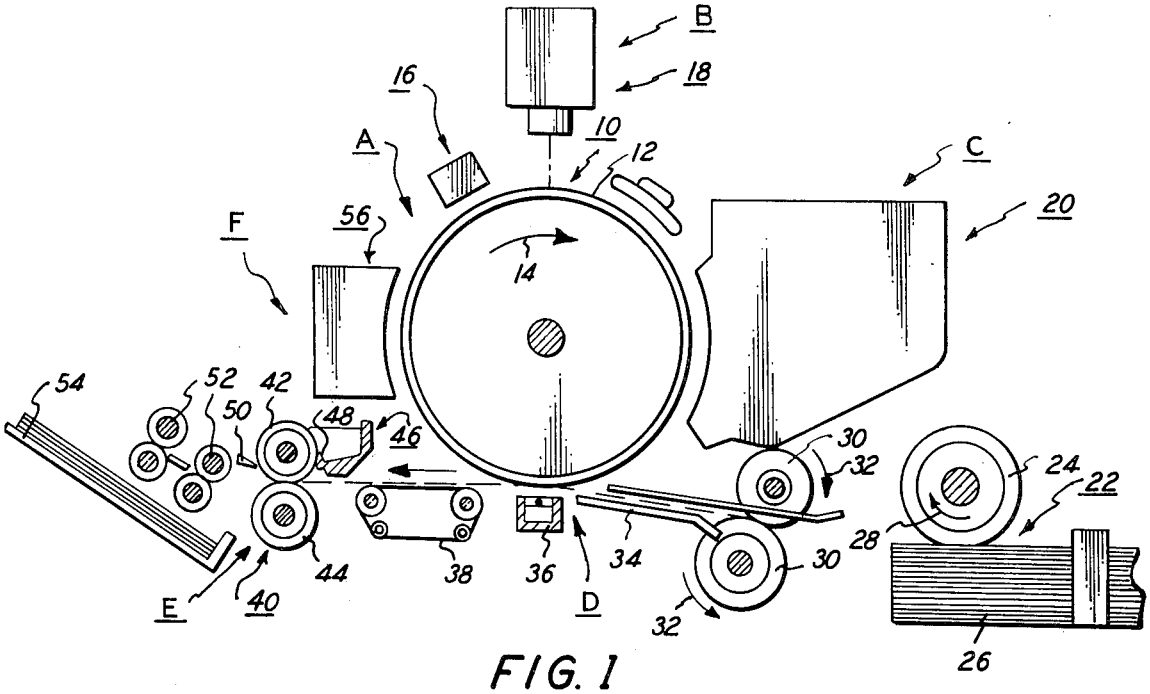
FIG. 1 is a schematic elevational view depicting an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the particles of the present invention are particularly well adapated for use in the development system of an electrophotographic printing machine, it should become evident from the following discussion that these particles are equally well suited for use in a wide variety of printing machines and are not necessarily limited to the particular embodiments shown herein.

The expression "composite particles" as herein employed is intended to refer to powders, liquid suspensions, colloids, or foams comprising the composite particles of the present invention for developing a latent image.

Hereinafter, an electrophotographic printing machine will be described as an illustrative embodiment employing the composite particles of the present invention in the development system thereof. Inasmuch as the art of electrophotographic printing is well known, the various processsing stations for producing a copy of an original document will be represented schematically in FIG. 1. Each of these processing stations will be described briefly hereinafter.

With continued reference to FIG. 1, the electrophotographic printing machine employs a drum 10 having a photoconductive surface 12 entrained about and secured to the exterior circumferential surface of a conductive substrate. Drum 10 is rotated in the direction of arrow 14 so that a portion of photoconductive surface 12 passes through the various processing stations disposed about its periphery. By way of example, photoconductive surface 12 may be a selenium alloy of the type described in U.S. Pat. No. 2,970,906 issued to Bixby in 1961, while the conductive substrate may be made from aluminum.

Initially, drum 10 rotates a portion of photoconductive surface 12 through charging station A. Charging station A includes a corona generating device, indicated generally by the reference numeral 16. Corona generating device 16 is located closely adjacent to photoconductive surface 12. When energized, corona generating device 16 charges a portion of photoconductive surface 12 to a relatively high substantially uniform potential. One type of suitable corona generating device is described in U.S. Pat. No. 2,836,725 issued to Vyverberg in 1958.

The charged portion of photoconductive surface 12 is rotated to exposure station B. Exposure station B includes an exposure mechanism, indicated generally by reference numeral 18, having a stationary housing for supporting an original document thereon. The housing comprises a transparent platen upon which the original document is located. Lamps illuminate the original document. Scanning of the original document is achieved by oscillating a mirror in a timed relationship with the movement of drum 10, or, in lieu thereof, by moving th lamps and lens system to form a flowing light image thereof. The light image of the original document is projected onto the charged portion of photoconductive surface 12. In this manner, photoconductive surface 12 is selectively irradiated to dissipate the charge thereon and record an electrostatic latent corresponding to the informational areas contained with the original document.

Next, the electrostatic latent image recorded on photoconductive surface 12 is rotated to development station C. At development station C, a developer unit 20 having a housing with a supply of composite particles therein renders the electrostatic latent image visible. The composite particles of the present invention have an insulating portion and a conductive portion contiguous and integral with one another. The detailed structure of the development apparatus and the associate particles employed therein will be described hereinafter with reference to FIGS. 2 through 4, inclusive. In general, the latent image attracts electrostatically the particles.

With continued reference to FIG. 1, a sheet of support material is advanced by sheet feeding apparatus 22 to transfer station D. Sheet feeding apparatus 22 includes a feed roll 24 contacting the uppermost sheet of stack 26. Feed roll 24 rotates in the direction of arrow 28 to advance the uppermost sheet from stack 26. Registration rollers 30, rotating in the direction of arrow 32, advance and align the sheet of support material into chute 34. Chute 34 directs the advancing sheet of support material into contact with drum 10 in a timed sequence so that the powder image developed thereon contacts the advancing sheet of support material at transfer station D. Transfer station D includes a corona generating device 36. Corona generating device 36 sprays ions onto the side of the sheet of support material opposed from photoconductive surface 12. The powder image adhering to photoconductive surface 12 is then attracted therefrom to the surface of the sheet of support material in contact therewith. After transferring the powder image to the sheet of support material, endless belt conveyer 38 advances the sheet of support material to fixing station E.

Fixing station E includes a fuser assembly, indicated generally by the reference number 40. Fuser assembly 40 heats the transferred powder image to permanently affix the particles to the sheet of support material. Perferably, fuser assembly 40 includes a heated fuser roll 42 and back-up roll 44. The sheet of support material with the powder image thereon, is interposed between fuser roll 42 and back-up roll 44. The powder image contacts fuser roll 42. Release material applicator 46 applies release material to fuser roll 42. Blade 48, closely adjacent to fuser roll 42, regulates the thickness of release material coating fuser roll 42. After the powder image is permanently affixed to the sheet of support material, stripper blade 50 separates the sheet from fuser roll 42. Thereafter, the sheet of support material is advanced by a series of rollers 52 to catch tray 54 for subsequent removal from the printing machine by the operator.

Invariably, residual particles remain adhereing to photoconductive surface 12 after the transfer of the powder image to the sheet of support material. These residual particles are removed from photoconductive surface 12 at cleaning station F. Cleaning station F includes a cleaning mechanism, generally designated by the reference numeral 56, having a corona generating device and a brush contacting photoconductive surface 12. Initially, the particles are brought under the influence of the corona generating device to neutralize the charge remaining on photoconductive surface 12 and that of the residual particles. Thereafter, the neutralized particles are removed from photoconductive surface 12 by the rotatably mounted fibrous brush in contact therewith. After cleaning, a discharge lamp floods photoconductive surface 12 to return it to the intitial level prior to the recharging thereof for the next successive imaging cycle.

It is believed that the foregoing description is sufficient for purposes of the present application to illustrate the general operation of an electrophotographic printing machine embodying the features of the present invention therein. Referring now to the specific subject matter of the present invention, FIG. 2 depicts developer unit 20 depositing the composite particles onto the latent image recorded on photoconductive surface of drum 10.

Figure 2:
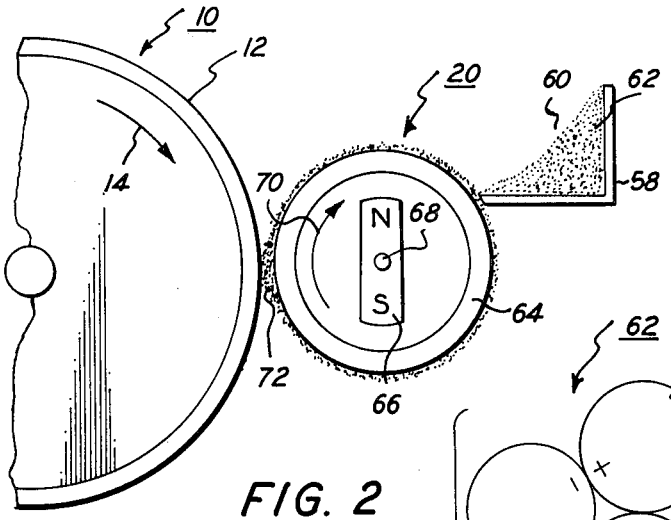
FIG. 2 is a fragmentary, sectional elevational view illustrating the developer unit employed in the FIG. 1 printing machine.

Turning now to FIG. 2, there is shown developer unit 20 in greater detail. As depicted therein, developer unit 20 includes a housing 58 defining a chamber 60 for storing a supply of composite particles 62 therein. Depositing means or developer roller 64 preferably is a tubular member made from a non-magnetic material such as aluminum. Tubular member 64 is interfit telescopically over magnetic member 66. Preferably, mangetic member 66 is a bar magnet made from barium ferrite. A shaft 68 made preferably of steel is mounted concentrically within tubular member 64 and serves as a support for magnetic member 66. A motor (not shown) is coupled to shaft 68 and rotates magnet 66 in the direction of arrow 70. Tubular member 64 remains substantially stationary. As magnetic member 66 rotates relative to tubular member 64, the composite particles are advanced from chamber 62 of housing 58 to development zone 72. A power supply (not shown) applies an electrical bias to tubular member 64. The voltage applied thereto may be about 500 volts. However, this voltage level is adjustable and depends upon the background voltage level of photoconductive surface 12. In operation, particles 62, in chamber 60 of housing 58, are attracted by the magnetic fields produced by magnetic member 68 to tubular member 64. As magnetic member 66 rotates, the composite particles move into development zone 72. In development zone 72, the composite particles are attracted from tubular member 64 to the latent image recorded on the photoconductive surface 12. Thus, it is evident that composite particles 52 are at least partially magnetic. As previously noted, composite particles 62 include an insulating portion integral and contiguous with a conductive portion. In the development system depicted in FIG. 2, the conductive portion may be magnetic or non-magnetic while the insulating portion may be magnetic or non-magnetic. However, at least one portion must be magnetic. In other types of printing processes such as photoelectrophoresis, the conductive and insulating portions may be magnetic or non-magnetic. Moreover, both portions may be magnetic or non-magnetic.

Figure 3:
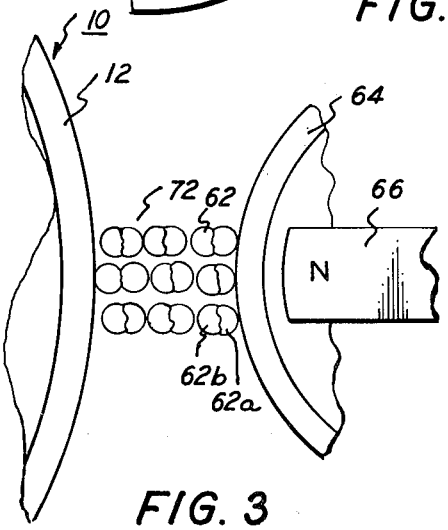
FIG. 3 is a fragmentary, sectional elevational view showing the composite particles used in the FIG. 2 developer unit.

FIG. 3 shows the alignment of the composite particles in development zone 72. By way of example, the composite particles illustrated in FIG. 3 comprise a magnetic conductive portion 62(*a*) and a non-magnetic insulating portion 62(*b*). As depicted therein, composite particles 62 form a brush-like array of fibers extending outwardly from tubular member 64. Magnetic member 66 causes composite particles 62 to align such that the magnetic portion 62(*a*) points towards magnetic member 66 while the non-magnetic portion 62(*b*) points towards photoconductive surface 12. Preferably, the electrical resistivity of conductive portion 62(*a*) ranges from about $10^4$ to about $10^9$ ohm-cm. The resistivity of insulating portion 62(*b*) preferably ranges from about $10^{14}$ to about $10^{17}$ ohm-cm. Conductive portion 62(*a*) is fused to insulating portion 62(*b*).

By way of example, insulating portion 62(*b*) of particles 62 is composed at least in the major part of a polyamide resin. As used herein, the term "polyamide resin" refers to the polymerization product resulting from the interaction of poly fatty acid or the ester of a poly fatty acid with ammonia and an amine selected from the group consisting primarily of amines, secondary amines and alkylated amines. In general, any polyamide resin may be employed providing the melting point of the resin is within the range of about 70° C. to about 165° C. Below 70° C., there is a danger of the resin being melted at the normal operating temperature of the machine, while temperatures about 165° C. cause charing of the copy sheet and may have a deleterious effect on the printing machine. Examples of suitable polyamides are the Versamid 930, 940 and 950 resins of General Mills, Inc., and the Polyamide 1155, 1144 and 1074 resins of Lawter Chemical Company. Other materials such as polystyrenes, polyesters, or ethylene/vinyl acetate copolymers may be used as well.

In general, any highly electrical conductive material, i.e. a material having a conductivity of at least $10^{-4}$ ohms cm, (such as a conductive metal), may be used in powdered form as the electrically conductive particles. Conductive materials may also include resins or polymers having conducting powders dispersed therein. For example, conductive portion 62(*a*) may be made of a ferromagnetic substance such as iron, magnetic iron oxide or magnetite, various magnetic metals and alloys, and the like. Fusible resins with magnetic or non-magnetic conductive pigment dispersed therein may also be employed. While particles of iron have found predominance, other substances such as nickel and nickel alloys, cobalt and cobalt alloys or chromium dioxide may also be employed. The major dimensions of composite particles 62 may range from about 1 micron to about 300microns with the preferred range being from about 5 microns to about 30 microns.

In an alternate embodiment, wherein composite particle 62 comprises a magnetic insulating portion 62(*b*) the insulating portion is made from a polyamide resin having a magnetic material such as ferromagnetic metal embedded therein as the core. In this manner, both the conductive portion 62(*a*) and insulating portion 62(*b*) are magnetic.

Figure 4:
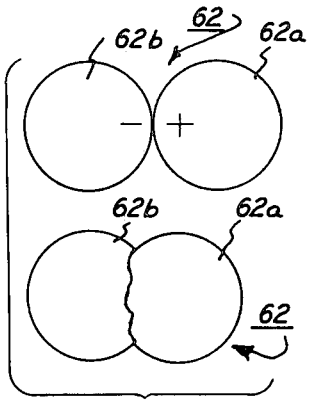
FIGS. 4*a–c* illustrates the general method of fabricating the composite particle.
Figure 4:
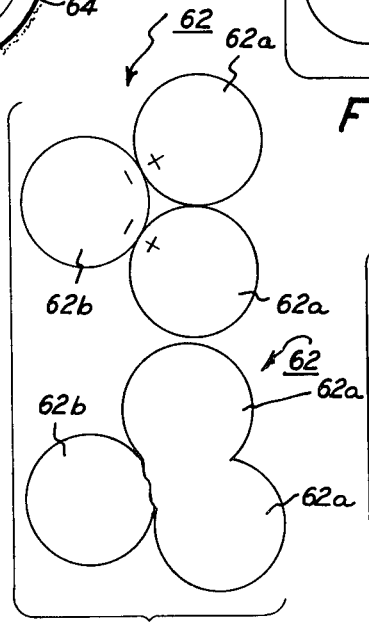
Figure 4:
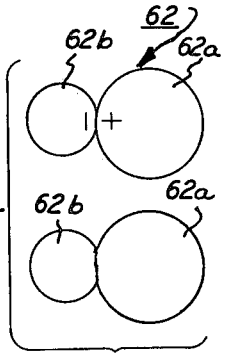

With continued reference to the drawings, FIG. 4 depicts various types of composite particles 62 and the method of fabrication thereof. As shown in FIG. 4(*a*) conductive particle 62(*a*) has a positive polarity relative to insulating particle 62(*b*). This results in triboelectric pairing of the particles. After the particles have been triboeletrically paired, they are fused to one another. The resultant particle 62 is elongated in shape and has insulating portion 62(*b*) and a conductive portion 62(*a*). As previously noted, conductive portion 62(*a*) and insulating portion 62(*b*) may be magnetic or non-magnetic depending upon the application therefor. With continued reference to FIG. 4(*a*), composite particle 62 is substantially symmetrical with conductive portion 62(*a*) being approximately the same size as insulating portion 62(*b*). However, this need not be the general case. For example, FIG. 4(*b*) depicts a pair of conductive particles 62(*a*) attracted triboelectrically to one insulating particle 62(*b*). Under these circumstances, the negative charge of insulating particle 62(*b*) is sufficient to attract two positively charged conductive particles 62(*a*). Once again, after the particles have been triboelectrically paired, they are fused to one another forming a composite particle. However, under these circumstances, composite particle 62 is asymmetrical with insulating portion 62(*b*) being smaller than conductive portion 62(*a*). Finally, FIG. 4(*c*) depicts a situation wherein insulating particle 62(*b*) is smaller than conductive particle 62(*a*). In this situation, insulating particle 62(*b*) has a negative polarity and conductive particle 62(*a*) has a positive polarity. After the particles are triboelectrically paired, they are permanently fused to one another resulting in a composite particle 62. Composite particle 62 comprises a conductive portion 62(*a*) which is larger than insulating portion 62(*b*). This results in composite particle 62 being asymmetrical.

In all of the foregoing cases, the conductive particle 62(*a*) is triboelectricaly paired with the insulating particle 62(*b*). Thereafter, the particles are permanently fused together. The paired or grouped particles are fused together by a heat spheriodization or melt dispersion process. Thus, the process for producing this particles is to make the individual particles, dry blend the particles at which time tribo-electric pairing occurs, and heat spheriodization or melt dispersion of the paired particles. Basically, the distinction between heat spheriodization and melt dispersion resides in the medium employed. In heat spheriodization air is employed, while melt dispersion uses a liquid, such as water. More particularly, a dry-powdered blend of particles is first obtained by any one of several standard techniques, for example, by melting a resin, allowing it to cool, then grinding and classifying the particles by size. The powder is then spheriodized, i.e. is moved into a moving air stream, to create an aerosol. This aerosol is directed through a hot air stream into a cooling chamber. The powder is then allowed to settle by gravity while cooling. The resulting powder is now made up of substantially spherical particles. The particles are then dry-blended with one anotherand the mixture is directed through a stream of gas, preferably air which can at least soften and preferably melt the resin and maintain it softened or melted for a period of time sufficient to permit the particles to become essentially fused to one another. The particles are then collected, such as by cyclone separation. If required, a small particle size flow agent such as Cab-O-Sil (finely divided silica, a trademark product of Cabot Corporation) is added to the particles to cause the particles to be sufficiently free flowing for use in electrophotographic printing.

In recapitulation, the present invention is directed to a composite particle which may be employed to develop a latent image. The composite particle includes a conductive portion and an insulating portion. The conductive and insulating portions may be magnetic or non-magnetic depending upon the required usage. The insulating properties of the composite particle enhance transfer of the particles from the photoconductive surface to the sheet of support material, while the conducting properties of the composite particle permit high quality development of the photoconductive surface. Thus, the composite particle of the present invention overcomes problems heretofore associated with developing and transferring particles.

It is, therefore, evident that there has been provided, in accordance with the present invention, a composite particle that fully satifies the object, aims and advantages hereinbefore set forth. While this invention has been described in conjunction with specific embodiments and methods of use therefor, it is evident that many alternatives, modifications and variations will be apparent to those skilled in the art. Accordingly, it is intended to embrace all such alternatives, modfications and variations as fall within the spirit and broad scope of the appended claims.

What is claimed is:

1. An electrophotographic printing machine, including:

a photoconductive member;

means for charging at least a portion of said photoconductive member to a substantially uniform level;

means for exposing the charged portion of said photoconductive member to a light image of an original document being reproduced; and means for developing the latent image recorded on said photoconductive member with composite particles having a conductive portion and an insulating portion with the conductive portion and insulating portion being integral and contiguous with one another.

2. A printing machine as recited in claim 1 wherein the conductive portion of the composite particles is magnetic.

3. A printing machine as recited in claim 1, wherein the insulating portion of the composite particles is non-magnetic.

4. A printing machine as recited in claim 2, wherein the insulating portion of the composite particles is magnetic.

5. A printing machine as recited in claim 1, wherein the conductive portion of the composite particles is non-magnetic.

6. A printing machine as recited in claim 5, wherein the insulating portion of the composite particles is magnetic.

7. A printing machine as recited in claim 6, wherein the insulating portion of the composite particles is non-magnetic.

8. A printing machine a recited in claim 1, wherein the conductive portion of the composite particles is of a first polarity and the insulating portion thereof is of a second plurality opposed to the first polarity.

9. A printing machine as recited in claim 1, wherein the composite particles are of an asymetrical configuration with the conductive portion being greater in size than the insulative portion.

10. A printing machine as recited in claim 1, wherein the composite particles are of a symetrical configuration with the conductive portion being substantially equal in size to the insulating portion.

11. An apparatus for developing a latent image recorded on a support member, including:

a housing defining a chamber for storing a supply of composite particles having a conductive portion and an insulating portion with the insulating portion and conductive portion being contiguous and integral with one another; and means, operatively associated with the composite particles stored in the chamber of said housing, for depositing the composite particles on the latent image recorded on the support member.

12. An apparatus as recited in claim 11, wherein the conductive portion of the composite particles sotred in the chamber of said housing is magnetic.

13. An apparatus as recited in claim 12, wherein the insulating portion of the composite particles stored in the chamber of said housing is non-magnetic.

14. An apparatus as recited in claim 12, wherein the insulating portion of the composite particles stored in the chamber of said housing is magnetic.

15. An apparatus as recited in claim 11, wherein the conductive portion of the conductive particles stored in the chamber of said housing is non-magnetic.

16. An apparatus as recited in claim 15, wherein the insulating portion of the composite particles stored in the chamber of said housing is magnetic.

17. An apparatus as recited in claim 16, wherein the insulating portion of the composite particles stored in the chamber of said housing is non-magnetic.

18. An apparatus as recited in claim 11, wherein the conductive portion of the composite particles stored in the chamber of said housing is of a first polarity and the insulating portion thereof is of a second polarity opposed to the first polarity.

19. An apparatus as recited in claim 11, wherein the composite particles stored in the chamber of said housing is of an asymetrical configuration with the conductive portion being greater in size than the insulating portion.

20. An apparatus as recited in claim 11, wherein the composite particles stored in the chamber of said housing is of a symetrical configuration with the conductive portion being substantially equal in size to the insulating portion.

* * * * *